US005792715A

United States Patent [19]

Duval et al.

[11] Patent Number: 5,792,715

[45] Date of Patent: Aug. 11, 1998

[54] METHOD OF MAKING A FIBROUS SUBSTRATE BY SUPERPOSING FIBROUS LAYERS, AND SUBSTRATE OBTAINED THEREBY

[75] Inventors: Renaud Jean Raymond Roger Duval, Couzon Au Mont D'or; Jean-Louis Maurice Cullerier, Bordeaux; Jean-Pascal Pirodon, Saint Genes Laval, all of France

[73] Assignee: Societe Europenne De Propulsion, Suresnes, France

[21] Appl. No.: 652,458

[22] Filed: Aug. 21, 1996

[30] Foreign Application Priority Data

Oct. 20, 1994 [FR] France ..... 94 12764

[51] Int. Cl.[6] ..... B32B 5/06

[52] U.S. Cl. ..... 442/328; 442/391; 442/392; 28/107; 28/110; 28/143

[58] Field of Search ..... 28/143, 111, 107, 28/110, 114; 442/388, 391, 392

[56] References Cited

U.S. PATENT DOCUMENTS

| | | | |
|---|---|---|---|
| 4,790,052 | 12/1988 | Olry | 28/110 |
| 5,504,979 | 4/1996 | Sheehan et al. | 28/43 |

FOREIGN PATENT DOCUMENTS

| | | |
|---|---|---|
| 0 424 988 | 5/1991 | European Pat. Off. . |
| 1308999 | 3/1973 | United Kingdom . |

*Primary Examiner*—Christopher Raimund
*Attorney, Agent, or Firm*—Bacon & Thomas

[57] ABSTRACT

Making fibrous substrates. The method consists for a given substrate thickness in adopting a displacement step size that varies in application of a step size reduction relationship adopted to impart constant thickness to the various superposed and bonded-togehter layer thickness making up said substrate thickness. Application to manufacturing friction parts.

13 Claims, 2 Drawing Sheets

FIG. 1
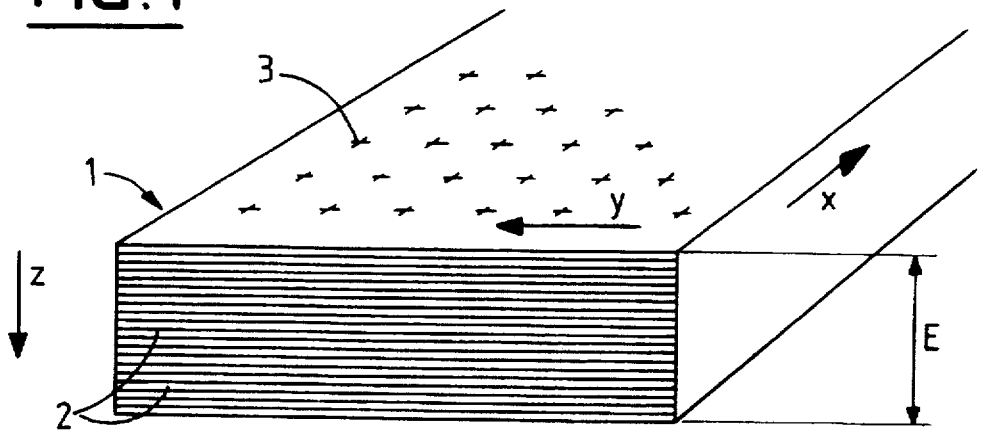
FIG. 2
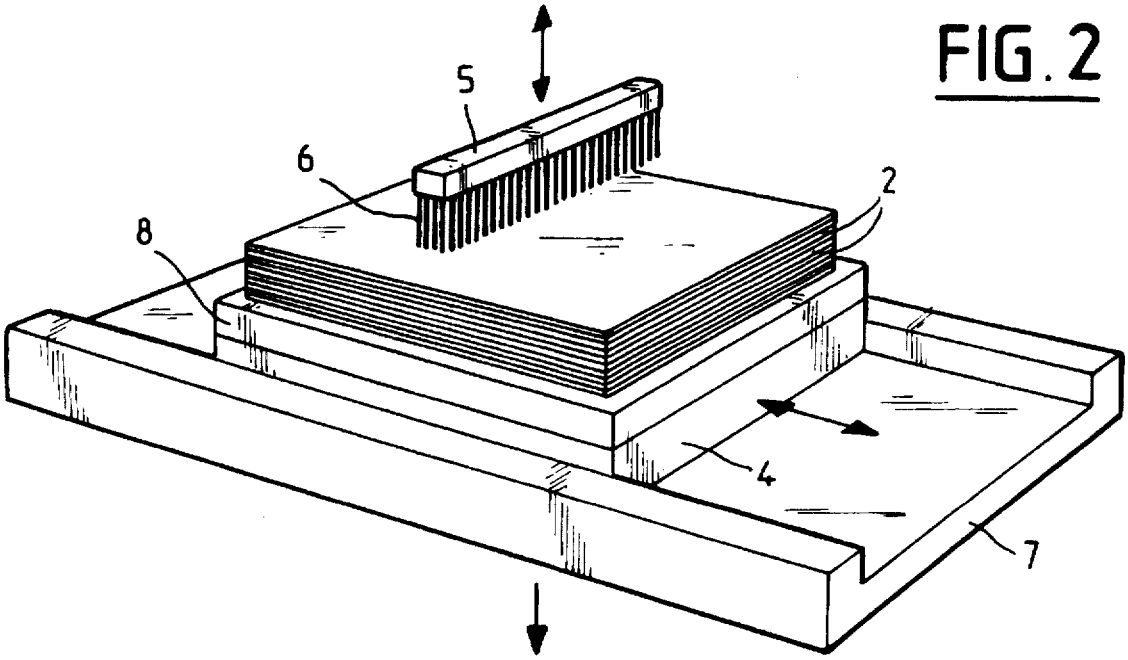
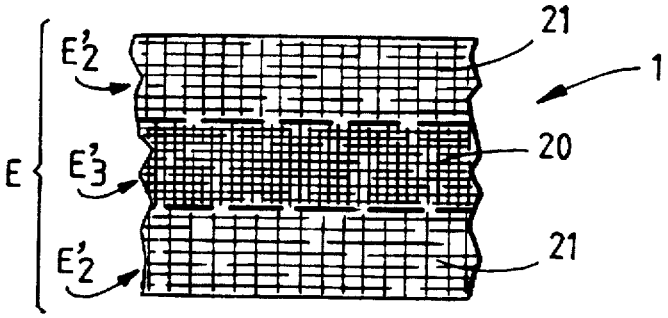
FIG. 4

METHOD OF MAKING A FIBROUS SUBSTRATE BY SUPERPOSING FIBROUS LAYERS, AND SUBSTRATE OBTAINED THEREBY

TECHNICAL FIELD

The present invention relates to the field of making fibrous substrates from fibrous layers which are superposed and successively needled together.

The invention relates more specifically to fibrous structures made from fibers that are precursors of carbon fibers.

PRIOR ART

The technique of manufacturing such fibrous substrates consists in building them up by superposing sheets that have sufficient cohesion to enable them to be superposed in successive layers.

A fibrous substrate is obtained by superposing a plurality of sheets and in bonding them together, in particular by needling, under conditions that are determined as a function of the intended application.

That method leads to a fibrous substrate that is dense to a greater or lesser extent and that can subsequently be subjected to cutting-out operations in order to obtain one or more preforms suitable for being subsequently subjected to operations of carbonization, densification, heat treatment, and finishing.

That technique of building up a fibrous substrate is well known and the equipment for implementing it comprises, in one method of manufacture, a "needling" table for supporting the successive superposed layers or sheets. The table is placed beneath a needling head which has a number of barbed needles that can be moved vertically to cause the needles to penetrate into the fibrous layers and, by taking hold of and displacing certain fibers, perform needling perpendicularly to the general plane of the superposed sheets.

In the prior art, mention should be made of application EP 0 232 059 which provides for causing the needles to act at constant penetration depth, while offsetting the depth by an amount equivalent to the thickness of layers each time they are superposed.

The end products that can be obtained by the above method can be considered as being generally good. Nevertheless, it has been observed that the products obtained are of homogeneous and coherent structure only if a relatively high real needling density (RND) has been used to bond together the successively superposed sheets. It can be assumed that such a high RND is equal at least to 1,500. The term "real needling density" (RND) is used to mean a function of the number of needle barbs per $cm^3$ as seen through a face of the layer or sheet. (Such an RND therefore includes needling density per unit area, penetration ratio in the z direction, downward step size, and also the functional characteristics of the needles.) From the above parameters, the resulting product is nevertheless not always satisfactory in the field of braking, and more particularly in the field of "heat sink" type brakes.

Because of the forces developed and the high temperatures that are established when using a brake of that type, it has been observed that brake disks present a physical characteristic that can be considered as being inappropriate, in that they accept little or no or too much possible deformation. Under such conditions, it is common to observe that the disks of a "heat sink" type brake do not co-operate with one another via their entire facing surfaces, such that unexpected braking conditions can arise.

To improve the suitability of such a product, it has been recommended to make a fibrous substrate based on preoxidized fibers presenting, after carbonization and densification, a volume fiber ratio Tf smaller than that generally used in the past and lying in the range 29% to 32%, and a z volume fiber ratio Tfz likewise smaller than the usual value which is about 6% to 10%.

It has thus been recommended that the volume fiber ratio Tf should be reduced to a value of less than 27% and that the z volume fiber ratio Tfz should be about 3%.

Attempts have been made to achieve such objectives by reducing the bonding density, in particular needling, down to about 30 strokes/$cm^2$. It turns out that such a method is unsuitable for providing a general solution to the problem posed since the general reduction in volume fiber ratio that can be obtained by such technical means is insufficient for achieving the intended objective.

Proposals have also been made to attempt to solve the problem posed by selecting a relative displacement step size, in particular a downwards step size, for the needling table that is about or greater than 1.6 mm, for example, and in any event slightly greater than the thickness of each superposed layer. The results obtained by acting on such a parameter on its own have been unconvincing.

Finally, attempts have been made to approach the problem by changing the penetration depth of the needles, and consequently the z bonding depth, e.g. by going from 14 mm to 12 mm, but no satisfactory result could be obtained therefrom.

It would appear that results going in the desired direction could be obtained providing action is taken simultaneously on all three of the above parameters. However, on the basis of tests that have been performed, it has been observed that the resulting fibrous substrate in which all three of the above parameters are reduced simultaneously possesses a structure that is not homogeneous, giving rise to bonded layer thicknesses that increase progressively going from the first layer (s) to be placed on the table and needled towards the last layers to be superposed. It would appear that such a resulting heterogeneous structure is due to a kind of bounce, padding, or spring effect, due to the progressively increasing superposition of layers or thicknesses of superposed layers which, by elastic reaction during needle penetration, gives rise to reduced efficiency of the needles.

Thus, as more layers are superposed, the thicknesses of the superposed layers are bonded less deeply to the underlying layers and each possesses residual thickness responsible for the bounce effect.

Such fibrous substrates cannot be used in satisfactory manner, even after densification, because their heterogeneous structure going from one face to the other alters the behavior of successive layers to braking forces and runs the risk of the layers becoming delaminated when a braking force is applied or during manufacturing steps.

The heterogeneous nature of a fibrous substrate has already been observed, in particular in patent U.S. Pat. No. 4,790,052. According to its teaching, it is recommended that for each superposed layer the distance between the needles and the layer support should be increased. It has been observed that in the intended application, that technique, although it gives advantageous results, does not enable the problem posed to be resolved.

SUMMARY OF THE INVENTION

The object of the invention is to seek to provide a novel method enabling the initially posed objective to be satisfied, namely providing a fibrous substrate presenting an adaptation of surface rigidity that differs from that which is obtained with the usual parameters for bonding, in particular needling, which is exempt from heterogeneous layer thicknesses, and which is suitable, after subsequent carbonization, densification and heat treatments, for providing friction and wear parts, in particular in the application to disk brakes, which parts offer an ability to adapt automatically to the counterparts with which they co-operate while braking force is being applied, thereby guaranteeing good co-operation between maximum wear areas brought into play.

To achieve the above objectives, the method of making a fibrous substrate by superposing fibrous layers of substantially constant thickness is of the type consisting in:

superposing a layer thickness on a first layer placed on a support;

bonding together the superposed layer thicknesses under given conditions using bonding means that operate substantially perpendicularly to the plane of the superposed layer thickness;

displacing the support relative to the bonding means through one step;

superposing a third layer thickness on the preceding layer thicknesses;

bonding the third layer thickness to the preceding layer thicknesses under the same conditions; and proceeding in the same manner for the following layers, making use of constant efficiency for the needles;

and is characterized in that it consists in adopting a varying step size between the support and the bonding means.

Various other characteristics appear from the description given below with reference to the accompanying drawings which show, as non-limiting examples, embodiments of the invention.

BRIEF DESCRIPTION OF THE DRAWINGS

FIG. 1 is a diagrammatic section through a fibrous substrate of the invention.

FIG. 2 is a diagram of a needling machine.

FIG. 4 is a fragmentary section showing one possibility of the invention.

BEST METHOD OF PERFORMING THE INVENTION

Figure 3:
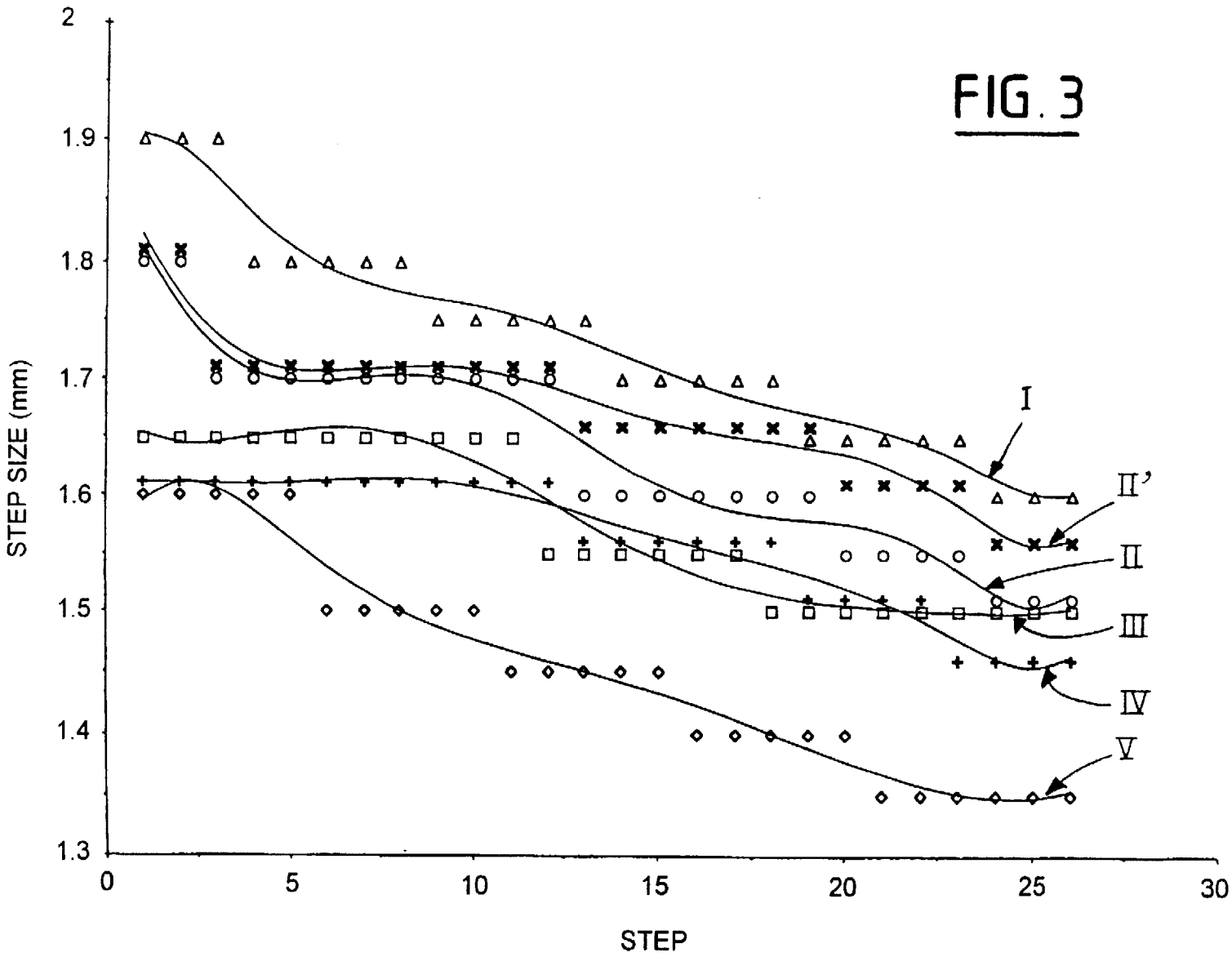
FIG. 3 is a graph summarizing various curves for implementing the bonding method of the invention.

FIG. 1 shows an example of a fibrous substrate 1 made up of a plurality of superposed fibrous layers 2 imparting a thickness E thereto, which layers are preferably bonded to one another e.g. by stitches 3, in particular by needling, which may be considered as being performed in a z direction relative to the x and y directions of the plane of each layer 2. The term "layer" 2 is used to mean any fibrous sheet of fibers that may or may not be aligned, that may or may not be pre-needled, and that may or may not be woven, knitted, or braided.

It should be considered that the invention applies to methods of manufacturing a substrate 1 that is other than plane, such as those consisting in forming a substrate by winding a sheet in cylindrical or helical, and in plane or conical manner, the sheet being made up of fibers that are precursors of carbon fibers (preoxidized PAN, tar, viscose, phenolic), carbon fibers, ceramic fibers, or precursors therefor, and mixtures of such fibers, whether they are continuous or discontinuous, and if discontinuous, they may also come from recycling offcuts from sheets or substrates.

To obtain a fibrous substrate 1 from layers 2 in the example of FIG. 1, and for a plane substrate 1, the procedure is as illustrated in FIG. 2.

Strips 2 of fibrous material of width and length that are determined as a function of the dimensions of the structure to be made are placed one by one on a horizontal slab 4. The strips 2 are stacked one on another and they are bonded together, e.g. by needling using a needle board 5 situated above the slab 4. The board 5 extends parallel to one of the sides of the slab 4 and over a length that is substantially equal to the length of said side, having its needles 6 pointing vertically downwards. The needles 6 may, for example, be of the type known under the reference 15×18×36×3.5C 333 G 1002, sold by the German firm GROZ-BECKERT.

The needle board 5 is secured to a driving device (not shown) which, in well known manner, imparts vertical reciprocating motion to the needles.

The needle board 5 and the stack of strips 2 are movable relative to each other in a horizontal direction and in a vertical direction. Horizontally, for example the slab 4 may be movable relative to a support table 7 perpendicularly to the board 5, under drive from drive means (not shown) mounted on the table 7. Vertically, relative movement between the slab 4 and the board 5 may be achieved by driving the table 7 with a worm-screw or other device for coupling it to a motor (not shown) fixed to a support structure for the needle board.

The slab 4 is preferably covered in a covering 8 into which the needles 6 can penetrate without damage when needling at the needling depth used during the first needling passes.

The method implemented consists in placing one or two superposed layers 2 on the slab 4, bonding, in particular by needling, and then lowering the table 7 through one needling step in order to enable a third layer 2 to be superposed and needled to the other two, and so on, until the desired number n of layers 2 have been superposed and needled together to confer the desired thickness E' to the fibrous substrate 1.

When manufacturing a substrate by winding a continuous sheet onto a mandrel, each turn of the mandrel causes a thickness of sheet to be wound. This thickness is considered as being equivalent to one layer in the above example.

Similarly, for each wound thickness, it is appropriate under such circumstances to move the transverse bonding means away from the mandrel by a corresponding amount. Such relative displacement must be considered as equivalent to the downwards step mentioned in the above example.

In order to ensure that the substrate 1 is characterized by a homogeneous structure having layers 2 of constant thickness after needling throughout its entire thickness E, the method of the invention seeks to select a relative displacement step between the bonding means and the substrate support that is of a size that is variable, and generally decreasing, as more and more thicknesses of layers 2 are superposed, starting with a basic step size corresponding substantially to the thickness intended for the layer 2 after bonding.

In one disposition of the invention, and in the application of FIGS. 1 and 2, a varying displacement step size is adopted in application of a step size reduction relationship which is selected as a function of the objective to be achieved and of the characteristics that are to be imparted to the substrate 1.

such as the total volume fiber ratio Tf, the z volume fiber ratio Tfz, and the thickness of the layers e/c after the substrate 1 has been built up.

For example, in an application that consists in using preoxided PAN fibers to produce fibrous supports 1 that are subsequently to be cut up to obtain fibrous preforms for subjecting to subsequent operations of carbonization and of densification in order to make wear or friction parts, such as brake disks, the range to be considered is that of using needles 6 of the above-specified type at a needling density da lying in the range 20 to 100 strokes/cm$^2$, a z needling penetration p as measured between the top face of the slab 4 and the tips of the needles 6 lying in the range 11 mm to 14 mm, and a specific mass ms for each layer 2 lying in the range 800 g/m$^2$ to 1400 g/$^2$.

In order to obtain a homogeneous structure with a volume fiber ratio that is constant overall, a z volume fiber ratio that is constant, and a layer thickness that is constant, FIG. 3 shows various different ways of intervening that enable the method of the invention to be defined overall, consisting in selecting a relative displacement relationship which, in the example selected, is a relationship governing downwards displacement of the needling table comprising, after needling together the first two initial layer thicknesses 2, a downward step size lying in the range 1.9 mm to 1.6 mm, in retaining such a downward step size for at least two successive superposed layers, and then reducing the downward step size for needling at least two other successive layers, and to continue in similar manner in stages, until adopting a final downward step size lying in the range 1.6 mm to 1.35 mm for at least the last two layers making up the thickness E that is to be imparted to the substrate 1.

In FIG. 3, curve I shows a specific operating process for obtaining a substrate 1 having:

an overall volume fiber ratio Tf of 40%±2;

a z volume fiber ratio Tfz of 3%±2;

a final layer thickness e/c of 1.85 mm±0.05.

The procedure is as follows, using the following needling parameters:

da=30 strokes/cm$^2$±5;

p=12.5 mm±0.5;

ms=1050 g/m$^2$±50 measured in an atmosphere of greater than 60% humidity.

After z bonding the first two superposed layers on the slab 4, three more layers are superposed and successively needled using a downward step size of 1.9 mm.

For the sixth layer and up to and including the tenth layer, a downward step size of 1.8 mm is adopted. For the eleventh layer through the fifteenth layer a downward step size of 1.75 mm is adopted, and then a downward step size equal to 1.70 mm is adopted for layers 16 through 20, and finally a downward step size of 1.65 mm is adopted for layers twenty-one through twenty-five.

Finally, and insofar as the thickness E is made up by superposing twenty-eight layers, which can be considered as common in the intended application, a downward step size of 1.6 mm is adopted for the last three layers.

Insofar as the thickness E may require two or three more layers to be superposed beyond twenty-eight, these extra layers will be subjected to the same downward step size as the last three layers above.

Finally, and in known manner, one or more finishing needling passes are performed with or without a change in step size so as to needle together appropriately the last layer(s).

In curve II, FIG. 3 gives a specific operating process for obtaining a substrate 1 having:

an overall volume fiber ratio Tf equal to 41%±3;

a z volume fiber ratio Tfz substantially equal to 3%±2;

a final layer thickness e/c substantially equal to 1.8 mm±0.05.

The following is performed using the following needling parameters:

da=30 strokes/cm$^2$±5;

p=12 mm±0.5;

ms=1050 g/m$^2$±50 measured under the same conditions as above.

After z bonding to the first two superposed layers on the slab 4, two layers 2 are superposed which are successively needled using a downward step size of 1.8 mm, then two layers are needled with a downward step size of 1.7 mm, then seven layers with a downward step size of 1.6 mm, followed by four layers with a downward step size of 1.55 mm, and finally three layers with a downward step size of 1.50 mm if the thickness E is to be made up of twenty-eight layers.

Curve III of FIG. 3 shows an operating process with the following needling parameters:

da=45 strokes/cm$^2$±5;

p=13.5 mm±0.5;

ms=1050 g/m$^2$±50 under the same conditions in order to obtain a substrate 1 having the following characteristics:

Tf=48%±4;

Tfz=5%±2;

e/c=1.7 mm±0.05.

On the first two layers, the following is performed:

twelve successive layers 2 are laid and bonded with a downward step size of 1.65 for each of them;

six layers are laid with a downward step size equal to 1.55;

finally the last eight layers are laid and bonded with a step size equal to 1.5, if the thickness E is made up of twenty-eight layers.

Curve IV of FIG. 3 shows the operations to be performed in the method of the invention in order to obtain a substrate 1 having the following characteristics:

Tf=50%±4;

Tfz=8%±2;

e/c=1.55 mm±0.05; using operating conditions such as:

da=85 strokes/cm$^2$±5;

p=13.5 mm±0.5;

ms=1050 g/m$^2$±50.

In accordance with the invention, starting from the initial first two successive layers the following applies:

twelve layers 2 are superposed with a downward step size equal to 1.6 mm;

six additional layers are laid with a downward step size equal to 1.55 mm;

four layers are laid with a downward step size of 1.5 mm;

and finally the last four layers are laid with a downward step size of 1.45 mm, if the thickness E is made up of twenty-eight layers.

Curve V shows a fifth variant consisting in proceeding as follows under operating conditions such as:

da=90 strokes/cm$^2$±5;

p=14 mm±0.5;

ms=1050 g/m$^2$±50; in order to obtain the following characteristics:

Tf=52%±4;

Tfz=10%±2;

e/c=1.5 mm±0.05.

After the first two layers 2, the following applies:

five downward steps at 1.6 mm;

five steps at 1.5 mm;

five more steps at 1.45 mm;

five further successive steps at 1.4 mm;

finally six successive steps at 1.35 mm if the thickness E is made up of twenty-eight layers.

In the above examples, a tolerance of 0.05 mm should be accepted on the downward step size adopted.

In another disposition of the invention, provision is made to implement the above method for two successive thicknesses of the same substrate 1 by adopting different operating steps so as to impart different characteristics to the resulting substrate 1 in at least two successive zones of its thickness.

It is thus possible to proceed as described above for making a thickness E by selecting operating steps as defined by curve II so as to form a thickness $E_2$ (see FIG. 4), and then by adopting the operating steps as defined by curve III or IV to obtain a successive thickness $E_3$, and then finally for a successive thickness $E'_2$ to use operating steps as defined by curve II' which, while retaining the same parameters as specified for curve II adopts the following displacement steps after the first two layers have been laid:

two displacement steps at 1.8 mm±0.05;

ten displacement steps at 1.7 mm±0.05;

seven displacement steps at 1.65 mm±0.05;

four displacement steps at 1.60 mm±0.05;

three displacement steps at 1.55 mm±0.05.

The resulting substrate 1 is characterized by an overall thickness that shows three sets of physical characteristics, two of which are similar and disposed on either side of a central portion.

The portions of thickness $E_2$ and $E'_2$ have volume fiber ratios Tf and z volume fiber ratios Tfz that are smaller than the ratios in the central portion, such that the substrate 1 has a structure that is suitable, e.g. after carbonization and densification, for obtaining a high density central portion constituting a core 20 that is mechanically strong and that is sandwiched between two less dense thicknesses that constitute "wear cheeks" 21 that provide better friction characteristics in the application to a braking system.

The long dashed lines in FIG. 4 mark the boundaries between the various portions, however it should not be assumed that these portions are physically defined as sharply as that.

The invention is not limited to the examples described and shown since various modifications can be applied thereto without going beyond the ambit of the invention. In particular, it would not go beyond the ambit of the invention if the z bonding between two successive thickness layers were to be performed by techniques other than needling. For example, in this respect, mention may be made of a bonding method based on high pressure water jets.

SUSCEPTIBILITY OF INDUSTRIAL APPLICATION

The manufacturing method of the invention is particularly suited to making fibrous substrates capable of constituting, directly or indirectly, preforms suitable for being subjected subsequently to one or more operations of carbonization and of densification in order to obtain, after machining, friction parts that are preferably used in braking systems of the type having disks or of the type having a disk and pads.

We claim:

1. A process for making a desired thickness of a fibrous substrate by superposing fibrous layers comprising the steps of:

superposing on a first fibrous layer placed on a support a second fibrous layer, bonding together the first and second layers under given conditions using needling means that operate substantially perpendicularly to said first and second layers, selecting a displacement step for moving away the support from the bonding means, using said select displacement step during a first stage of the process concerning the superposition of at least one new fibrous layer, said first stage comprising for each new fibrous layer the steps of:

displacing the support away from the bonding means through said selected displacement step, superposing on the preceding layer a new fibrous layer which thickness is substantially equal to the thickness of said second layer, bonding said new fibrous layer on said preceding layers using said needling means under said given conditions, proceeding in a similar manner for each new layer to be applied by said first stage, reducing said displacement step, using said reduced displacement step during a new following stage of the process concerning the superposition of at least one new fibrous layer which thickness is substantially equal to the thickness of said second layer, said following stage being similar to the first stage except for the reduced displacement step and eventually the number of new fibrous layers, repeating the process from the reducing the displacement step stage as many time as it is necessary to form the desired thickness of the substrate.

2. The process of claim 1 wherein the displacement step is selected and then reduced successively for said first stage and at least one following stage in order to impart constant thickness to the various superposed and bonded together fibrous layers making up said desired substrate thickness.

3. The process of claim 1 wherein said given conditions are the following needling parameters:

da—is in the range 30 to 90 strokes/$cm^2$±5;

p—is in the range 12.5 mm to 14 mm±0.5;

ms—is about 1050 g/$m^2$±50;

in order to obtain:

tf—is in the range 40% to 52%±2 to 4;

Tfz—is in the range 3% to 10%±2; and e/c—is in the range 1.85 mm to 1.5 mm±0.05;

said displacement step is selected lying in the range 1.9 mm to 1.6 mm, for said first stage comprising superposing at least two new fibrous layers, said displacement step is then reduced for in said new following stages each concerning at least two new fibrous layers, said displacement step being successively reduced in order that it lies in the range 1.6 mm to 1.35 mm for the last stage comprising superposing at least two new fibrous layers.

4. The process of claim 1 wherein said desired thickness is formed by 28 superposed fibrous layers, of substantially constant thickness.

5. A process of claim 1, wherein a displacement relationship is adopted for a desired substrate thickness and then a different relationship for a following other desired thickness of the same substrate.

6. A fibrous substrate built up on the basis of plurality of fibrous layers, that are progressively superposed and successively bonded together, said fibrous substrate including at least one desired thickness obtained by implementing the method according to claim 1, and in which the successive superposed and bonded-together fibrous layers are of constant thickness.

7. A fibrous substrate built up on the basis of a plurality of fibrous layers, that are progressively superposed and successively bonded together, said fibrous substrate including at least one desired thickness obtained by implementing the method according to claim 1, and in which the successive superposed and bonded together fibrous layers are of constant thickness, further including at least one second desired obtained thickness by implementing the method according to claim 1, said second desired thickness following the first desired thickness and bonded thereto, the fibrous layers of said second thickness having constant thickness but different from the thickness of the fibrous layers of the first desired thickness.

8. A process for making a desired thickness of fibrous substrate by superposing fibrous layers comprising the steps of:

superposing on a first fibrous layer placed on a support a second fibrous layer, bonding together the first and second layers under given conditions using needling means that operate substantially perpendicularly to said first and second layers, said given conditions being the following parameters:

da=strokes/cm$^2$±5;

p=12.5 mm±0.5;

ms=1050 g/m$^2$±50;

Tf=40%±2;

Tfz=3%±2;

e/c=1.85 mm±0.05 selecting a displacement step of 1.90 mm±0.5, using said selected displacement step during a first stage concerning the superposition of three new fibrous layers which thickness is substantially equal to the thickness of said second layer, said first stage comprising, for each new fibrous layer, the steps of:

displacing the support away from needling means through said selected displacement step, superposing on preceding layers said new fibrous layer, bonding said new fibrous layer using said needling means under said given conditions, reducing the displacement step to 1.80 mm±0.05, using this reduced displacement step during a second stage concerning five new fibrous layers which thickness is substantially equal to the thickness of said second layer, said second stage being similar to the first stage except for the displacement step size and the number of new fibrous layers, reducing the displacement step to 1.75 mm±0.05, using this reduced displacement step during a third stage concerning five new fibrous layers which thickness is substantially equal to the thickness of said second layer, said third stage being similar to the first stage except for the displacement step size and the number of new fibrous layers, reducing the displacement step to 1.70 mm±0.05 using this reduced displacement step during a fourth stage concerning five new fibrous layers which thickness is substanially equal to the thickness of said second layer, said fourth stage being similar to the first stage except for the displacement step size and the number of new fibrous layers, reducing the displacement step to 1.65 mm±0.05, using this reduced displacement step during a fifth stage concerning five new fibrous layers which thickness is substantially equal to the thickness of said second layer, said fifth stage being similar to the first stage except for the displacement step size and the number of new fibrous layers, reducing the displacement step to 1.60 mm±0.05 using this reduced displacement step during a sixth stage concerning three new fibrous layers which thickness is substantially equal to the thickness of said second layer, said sixth stage being similar to the first stage except for the displacement step size and the number of new fibrous layers.

9. A process for making a desired thickness of fibrous substrate by superposing fibrous layers comprising the steps of:

superposing on a first fibrous layer placed on a support a second fibrous layer, bonding together the first and second layer under given conditions using needling means that operate substantially perpendicularly to said first and second layers, said given conditions being the following parameters:

da=30 strokes/cm$^2$±0.5;

p=2 mm±0.5;

ms=1050 g/m$^2$±50;

Tf=41%±50;

Tfz=3%±2;

e/c=1.8 mm±0.05;

selecting a displacement step of 1.80 mm±0.05, using said selected displacement step during a first stage concerning the superposition of two new fibrous layers which thickness is substantially equal to the thickness of said second layer, said first stage comprising, for each new fibrous layer, the steps of:

displacing the support away from needling means through said selected displacement step, superposing on preceding layers said new fibrous layer, bonding said new fibrous layer using said needling means under said given conditions, reducing the displacement step to 1.70 mm±0.05, using this reduced displacement step during a second stage concerning ten new fibrous layers of which thickness is substantially equal to the thickness of said second layer, said second stage being similar to the first stage except for the displacement step size and the number of new fibrous layers, reducing the displacement step to 1.60 mm±0.05, using this reduced displacement step during a third stage concerning seven new fibrous layers which thickness is substantially equal to the thickness of said second layer, said third stage being similar to the first stage except for the displacement step size and the number of new fibrous layers, reducing the displacement step to 1.55 mm±0.05, using this reduced displacement step during a fourth stage concerning four new fibrous layers which thickness is substantially equal to the thickness of said second layer, said fourth stage being similar to the first stage except for the displacement step size and the number of new fibrous layers, reducing the displacement step to 1.50 mm±0.05, using this reduced displacement step during a fifth stage concerning three new fibrous layers which thickness is substantially equal to the thickness of said second layer, said fifth stage being similar to the first stage except for the displacement step size and the number of new fibrous layers.

10. A process for making a desired thickness of fibrous substrate by superposing fibrous layers, comprising the steps of:

superposing on a first fibrous layer placed on a support a second fibrous layer, bonding together the first and second layer under given conditions using needling means that operate substantially perpendicularly to said first and second layers, said given condition being the following parameters:

da=30 strokes/cm$^2$±5;

p=12 mm±0.5;

ms=1050 g/m$^2$±50;

Tf=41%±3;

Tfz=3%±2;

e/c=1.8 mm±0.05;

selecting a displacement step of 1.80 mm±0.05, using said selected displacement step during a first stage concerning the superposition of two new fibrous layers which thickness is substantially equal to the thickness of said second layer, said first stage comprising, for each new fibrous layer, the steps of:

displacing the support away from needling means through said selected displacement step, superposing on preceding layers said new fibrous layer, bonding said new fibrous layer using said needling means under said given conditions, reducing the displacement step to 1.70 mm±0.05, using this reduced displacement step during a second stage of the process concerning ten new fibrous layers which thickness is substantially equal to the thickness of said second layer, said second stage being similar to the first stage except for the displacement step size and the number of new fibrous layers, reducing the displacement step to 1.65 mm±0.05, using this reduced displacement step during a third stage of the process concerning seven new fibrous layers which thickness is substantially equal to the thickness of said second layer, said third stage being similar to the first stage except for the displacement step size and the number of new fibrous layers, reducing the displacement step to 1.60 mm±0.05, using this reduced displacement step during a fourth stage of the process concerning four new fibrous layers which thickness is substantially equal to the thickness of said second layer, said fourth stage being similar to the first stage except for the displacement step size and the number of new fibrous layers, reducing the displacement step to 1.55 mm±0.05, using this reduced displacement step during a fifth stage of the process concerning three new layers which thickness is substantially equal to the thickness of said fifth layer, said fifth stage being similar to the first stage except for the displacement step size and the number of new fibrous layers.

11. A process for making a desired thickness of fibrous substrate, by superposing fibrous layers, comprising the steps of:

superposing on a first fibrous layer placed on a support a second fibrous layer, bonding together the first and second layer under given conditions using needling means that operate substantially perpendicularly to said first and second layers, said given condition being the following parameter:

da=45 strokes/cm$^2$±5;

p=13.5 mm±0.5;

ms=1050 g/m$^2$±50;

Tf=48%±4;

Tfz=5%±2;

e/c=1.7 mm±0.05;

selecting a displacement step of 1.65 mm±0.05, using said selected displacement step during a first stage concerning the superposition of twelve new fibrous layers which thickness is substantially equal to the thickness of said second layers, said first stage comprising for each new fibrous layers, the steps of:

displacing the support away from needling means through said selected displacement step, superposing on preceding layers said new fibrous layer, bonding said new fibrous layer using said needling means under said given conditions, reducing the displacement step to 1.55 mm±0.05, using this reduced displacement step during a second stage concerning six new fibrous layers which thickness is substantially equal to the thickness of said second layer, said second stage being similar to the first stage except for the displacement step size and the number of new fibrous layers, reducing the displacement step to 1.50 mm±0.05, using this reduced displacement step during a third stage concerning eight new fibrous layers which thickness is substantially equal to the thickness of said second layer, said third stage being similar to the first stage except for the displacement step size and the number of new fibrous layers.

12. A process for making a desired thickness of fibrous substrate by superposing fibrous layers comprising the steps of:

superposing on a first layer fibrous placed on a support a second fibrous layer, bonding together the first and second layer under given conditions using needling means that operate substantially perpendicularly to said first and second layers, said given condition being the following parameter:

da=85 strokes/cm$^2$±5;

p=13.5 mm±0.5;

ms=1050 g/m$^2$±50;

Tf=50%±4;

Tfz=8%±2;

e/c=1.55 mm±0.05;

selecting a displacement step of 1.60 mm±0.05, using said selected displacement step during a first stage concerning the superposition of twelve new fibrous layers which thickness is substantially equal to the thickness of said second layer, said first stage comprising, for each new fibrous layers, the steps of:

displacing the support away from needling means through said selected displacement step, superposing on preceding layers said new layer, bonding said new fibrous layer using said needling means under said given conditions, reducing the displacement step to 1.55 mm±0.05, using this reduced displacement step during a second stage concerning six new fibrous layers which thickness is substantially equal to the thickness of said second layer, said second stage being similar to the first stage except for the displacement step size and the number of new fibrous layers, reducing the displacement step to 1.50 mm±0.05, using this reduced displacement step during a third stage concerning four new fibrous layers which thickness is substantially equal to the thickness of said second layer, said third stage being similar to the first stage except for the displacement step size and the number of new fibrous layers, reducing the displacement step to 1.45 mm±0.05, using this reduced displacement step during a fourth stage of the process concerning four new layers which thickness is substantially equal to the thickness of said second layer, said fourth stage being similar to the first stage except for the displacement step size and the number of new fibrous layers.

13. A process for making a desired thickness of fibrous substrate by superposing fibrous layers comprising the steps of:

superposing on a first fibrous layer place on a support a second fibrous layer, bonding together the first and second layer under given conditions using needling means that operate substantially perpendicularly to said first and second layers, said given condition being the following parameters:

da=90 strokes/cm$^2$±5;

p=14 mm±0.5;

ms=1050 g/m$^2$±50;

Tf=52%±4;

Tfz=10%±2;

e/c=1.5 mm±0.05;

selecting a displacement step of 1.60 mm±0.05, using said selected displacement step during a first stage of the process concerning the superposition of five new layers which thickness is substantially equal to the thickness of said second layer, said first stage comprising, for each new fibrous layer, the steps of:

displacing the support away from needling means throughout said selected displacement step, superposing on preceding layers said new fibrous layer, bonding said new layer using said needling means under said given conditions, reducing the displacing step to 1.50 mm±0.05, using this reduced displacement step during a second stage concerning five new fibrous layers which thickness is substantially equal to the thickness of said second layer, said second stage being similar to the first stage except for the displacement step size, reducing the displacement step to 1.45 mm±0.05, using this reduced displacement step during a third stage concerning five new fibrous layers which thickness is substantially equal to the thickness of said second layer, said third stage being similar to the first stage except for the displacement step size, reducing the displacement step to 1.40 mm±0.05, using this reduced displacement step during a fourth stage concerning five new fibrous layers which thickness is substantially equal to the thickness of said second layer, said fourth stage being similar to the first stage except for the displacement step size, reducing the displacement step to 1.35 mm±0.05, using this reduced displacement step during a fifth stage of the process concerning six new fibrous layers which thickness is substantially equal to the thickness of said second layer, said fifth stage being similar to the first stage except for the displacement step size and the number of new fibrous layers.

* * * * *

UNITED STATES PATENT AND TRADEMARK OFFICE

CERTIFICATE OF CORRECTION

PATENT NO. : 5,792,715

DATED : August 11, 1998

INVENTOR(S) : DUVAL et al.

It is certified that error appears in the above-identified patent and that said Letters Patent is hereby corrected as shown below:

On the title page, change Item [73] to read as follows:

--[73] Assignees: Societe Europenne De Propulsion (Suresnes, FR); and Carbone Industrie (Villeurbanner, FR)-.

Signed and Sealed this

Twelfth Day of December, 2000

*Attest:*

*Attesting Officer*

Q. TODD DICKINSON

*Director of Patents and Trademarks*